US006514153B2

(12) United States Patent
Miyamoto et al.

(10) Patent No.: US 6,514,153 B2
(45) Date of Patent: Feb. 4, 2003

(54) GOLF CLUB HEAD

(75) Inventors: Masahiko Miyamoto, Hiratsuka (JP); Yoh Nishizawa, Hiratsuka (JP)

(73) Assignee: The Yokohama Rubber Co., Ltd., Tokyo (JP)

( * ) Notice: Subject to any disclaimer, the term of this patent is extended or adjusted under 35 U.S.C. 154(b) by 0 days.

(21) Appl. No.: 09/784,201

(22) Filed: Feb. 16, 2001

(65) Prior Publication Data

US 2001/0021675 A1 Sep. 13, 2001

(30) Foreign Application Priority Data

Feb. 21, 2000 (JP) ..... 2000-042992

(51) Int. Cl.[7] ..... A63B 53/04
(52) U.S. Cl. ..... 473/305; 473/314; 473/345
(58) Field of Search ..... D21/733; 473/345, 473/346, 339, 310, 305, 314, 327, 337

(56) References Cited

U.S. PATENT DOCUMENTS 5,338,029 A * 8/1994 Falzone
5,685,784 A * 11/1997 Butler
5,692,971 A * 12/1997 Williams
5,797,806 A * 8/1998 Butler
5,865,687 A * 2/1999 Alzano
6,050,903 A * 4/2000 Lake

* cited by examiner

*Primary Examiner*—Stephen Blau
(74) *Attorney, Agent, or Firm*—Finnegan, Henderson, Farabow, Garrett & Dunner, L.L.P.

(57) ABSTRACT

A golf club head of the present invention is the one in which a head main body of a hollow structure is formed of; a face portion having a face surface; the crown portion adjacent to the face portion; and a sole portion adjacent to the face portion, a through hole for inserting a shaft into the crown portion is provided, the hosel portion for supporting a tip portion of the shaft is joined to a back surface of the face portion, and the hosel portion is made to be in a non-contact state with the crown portion.

5 Claims, 7 Drawing Sheets

GOLF CLUB HEAD

BACKGROUND OF THE INVENTION

The present invention relates to a golf club head having a hollow structure. More particularly, the present invention relates to a golf club head that makes it possible to increase a carry and to improve a ball direction control.

When the golf club head hits a ball off from its sweet spot, rotation occurs around the center of gravity of the golf club head, thus giving the ball a spin. Such a mechanism of the spin occurrence is generally called a gear effect. It is known that, according to the gear effect, the spin is given in a direction that brings a ball landing point to the central area of a golf course when a striking point is off from the sweet spot in a toe or heel direction, and the spin is given in a direction that increases the carry when the striking point is off from the sweet spot in an upper or lower direction.

However, since the golf club head generally has a stiff constitution in which a hosel portion is joined to a crown portion, only the rotation around the center of gravity is obtained when the ball is stricken off from the sweet spot. Thus, the carry-increasing effect and the improving effect of the ball direction control by the gear effect have been insufficient.

SUMMARY OF THE INVENTION

The object of the present invention is to provide a golf club, in which a relative displacement between a head main body and the hosel portion is permitted when a ball is stricken, thereby making it possible to increase a carry and to improve a ball direction control.

The golf club head according to the present invention to achieve the foregoing object is characterized in that the head main body of a hollow structure is formed of; a face portion having a face surface; the crown portion adjacent to the face portion; and a sole portion adjacent to the face portion, a through hole for inserting a shaft into the crown portion is provided, the hosel portion for supporting a tip portion of the shaft is joined to a back surface of the face portion, and the hosel portion is made to be in a non-contact state with the crown portion.

As described above, since the hosel portion for supporting the tip portion of the shaft is joined to the back surface of the face portion, and the hosel portion is made to be in the non-contact state with the crown portion, the relative displacement between the head main body and the hosel portion is permitted according to an impact when a ball striking position does not coincide with the joined portion between the hosel portion and the face portion. As a result, an appropriate spin is given to the ball and further increase of the carry and further improvement of the ball direction control can be achieved.

Moreover, there is an advantage that a break of the shaft can be prevented, because the head main body and the hosel portion relatively displace to reduce a load to the shaft.

In the present invention, blocking a gap between the through hole of the crown portion and the hosel portion with an elastic member prevents a foreign object from entering the head main body from the through hole. The elastic member does not interfere the relative displacement between the head main body and the hosel portion, and can be constituted of rubber or resin.

The joined portion between the hosel portion and the face portion can be arranged at a position that coincides with the sweet spot of the face surface or a position off from the sweet spot. When the joined portion between the hosel portion and the face portion is arranged at the position that coincides with the sweet spot of the face surface, the above-described increasing effect of the carry and the improving effect of the ball direction control can be obtained. On the other hand, when the joined portion between the hosel portion and the face portion is arranged at the position off from the sweet spot of the face surface, a spin characteristic of the ball can be optionally set at a golfer's request.

In the present invention, the sweet spot means a crossing point of a perpendicular line from the center of gravity of the head main body to the face surface, and the face surface. The position that coincides with the sweet spot of the face surface means a position where at least a part of the joined portion between the hosel portion and the face portion overlaps the sweet spot. On the other hand, the position off from the sweet spot of the face surface means a position where the joined portion between the hosel portion and the face portion does not overlap the sweet spot at all.

DETAILED DESCRIPTION OF THE PREFERRED EMBODIMENTS

Figure 1:
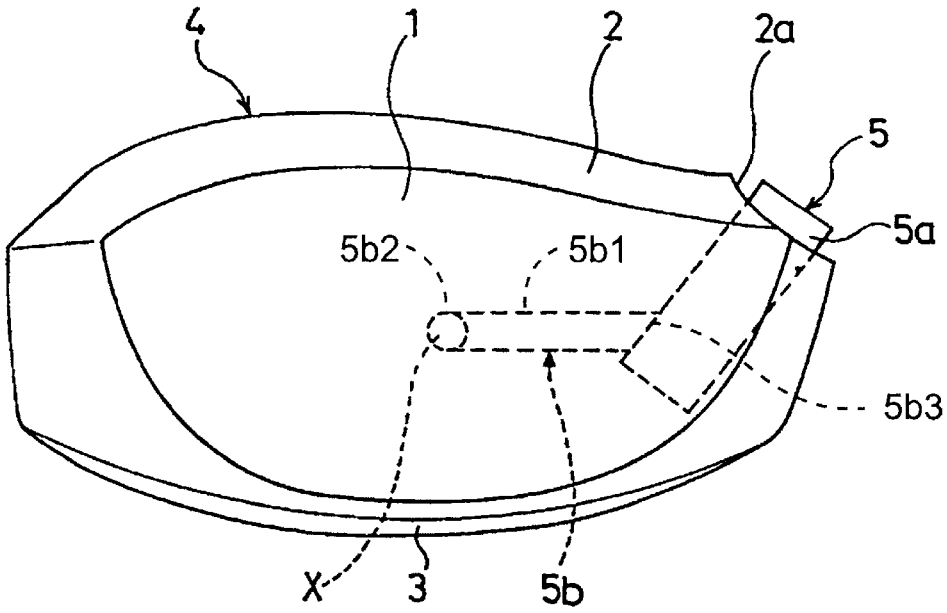
FIG. 1 is a front view of the golf club head according to the embodiment of the present invention.
Figure 2:
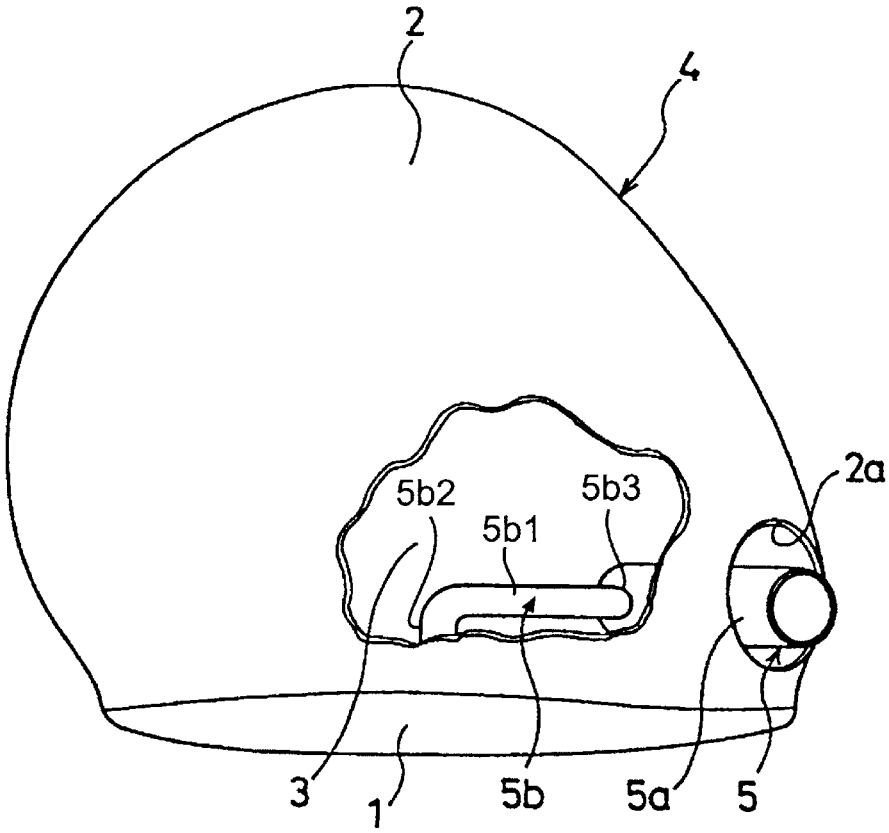
FIG. 2 is a partially notched plan view of the golf club head according to the embodiment of the present invention.
Figure 3:
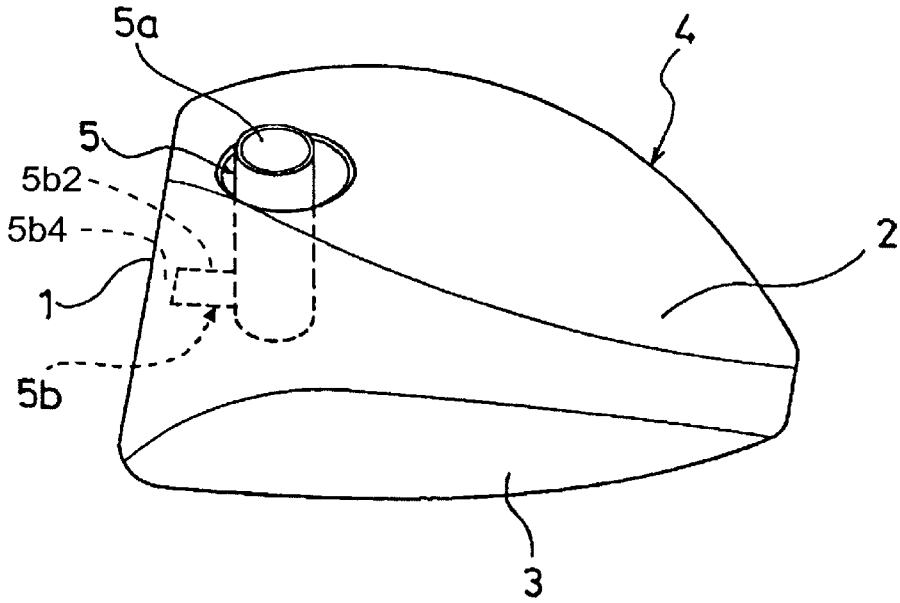
FIG. 3 is a side view of the golf club head according to the embodiment of the present invention.
Figure 4:
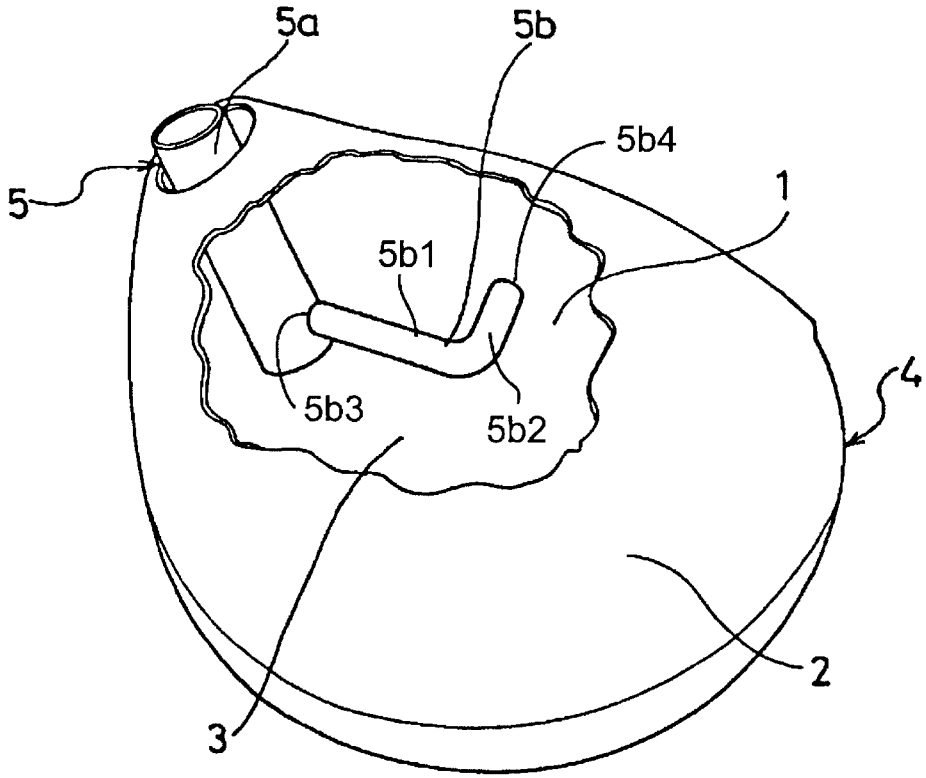
FIG. 4 is a partially notched perspective view of the golf club head according to the embodiment of the present invention.

A constitution of the present invention will be described with reference to the annexed drawings hereinafter.

FIGS. 1 to 5 show the golf club heads according to the embodiment of the present invention. The golf club head according to the embodiment comprises a head main body 4 of the hollow structure, which is surrounded by: a face portion 1 having the face surface as a ball striking surface; a crown portion 2 adjacent to the face portion 1; and a sole portion 3 adjacent to the face portion 1. The head main body 4 can be constituted of a metal such as titanium, stainless steel, aluminum or the like. In addition, the sweet spot is set at an approximate center of the face surface of the face portion 1.

A through hole 2*a* for inserting the shaft is formed in the crown portion 2. On the other hand, a hosel portion 5 for supporting the tip portion of the shaft is joined to the back surface of the face portion 1, and is in the non-contact state with the crown portion 2. As may be seen in FIGS. 1–4, the hosel portion 5 includes a cylindrical shaft support portion 5*a* extending from the inside of the head to the outside via the through hole 2*a,* and a generally L-shaped connection portion 5*b* for connecting the shaft support portion 5*a* to the back surface of the face portion 1. The L-shaped connection portion 5*b* has two arms 5*b*1 and 5*b*2, each having a free end 5*b*3 and 5*b*4, respectively. The free end 5*b*3 of the arm 5*b*1 is joined to the shaft support portion 5*a* so that the arm 5*b*1 extends from the shaft support portion 5*a* in generally parallel spaced relation to both the face portion 1 and the sole portion 3. The arm 5*b*2 lies generally perpendicular to the face portion 1 and its free end portion 5*b*4 is joined to the back surface of of the face portion 1 at a position X.

Figure 5:
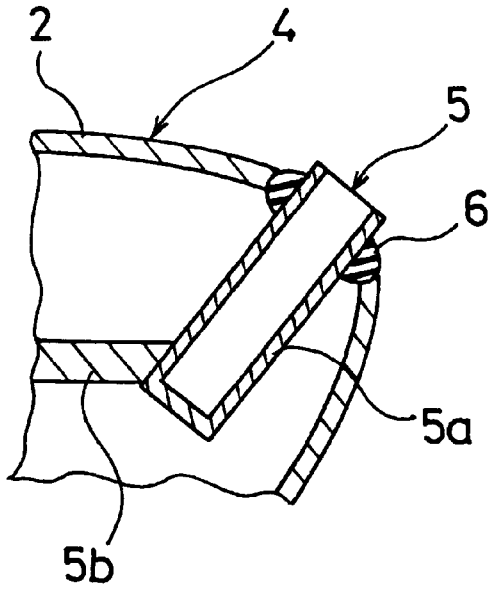
FIG. 5 is a sectional view showing a principle portion of the golf club head according to the embodiment of the present invention.

As shown in FIG. 5, it is preferable that a ring-shaped elastic member 6 is fit around the hosel portion 5 to block the gap between the through hole 2*a* of the crown portion 2 and the hosel portion 5 by the elastic member 6. Although the elastic member 6 prevents the foreign object such as water, dust or the like from entering the head main body 4 from the through hole 2*a*, it does not regulate the relative displacement of the head main body 4 and the hosel portion 5. As a material for the elastic member 6, in addition to rubber such as styrene-butadiene rubber (SBR), butadiene rubber (BR) and natural rubber (NR) or the like, resin having flexibility such as polyethylene, polystyrene, nylon or the like can be used. It is preferable that the gap between the through hole 2*a* of the crown portion 2 and the hosel portion 5 is set in a range of 1 to 3 mm.

As described above, the hosel portion 5 is joined to the back surface of the face portion 1 and is in the non-contact state with the crown portion 2. Accordingly, when the ball striking position does not coincide with the joined portion X between the hosel portion 5 and the face portion 1, the connection portion 5*b* of the hosel portion 5 is mainly deformed according to an impact, thus the head main body 4 and the hosel portion 5 relatively displace.

Figure 6:
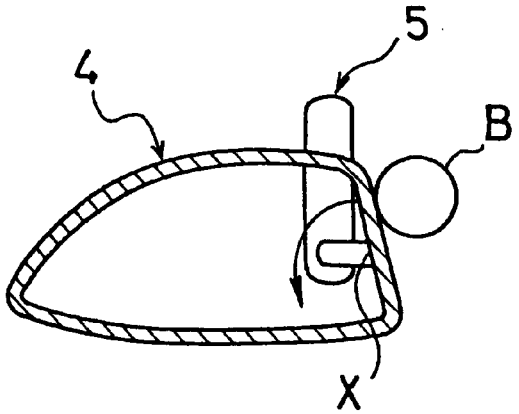
FIG. 6 is an exemplary view showing a displacement when the ball is stricken at an upper side of the face surface of the golf club head according to the present invention.
Figure 7:
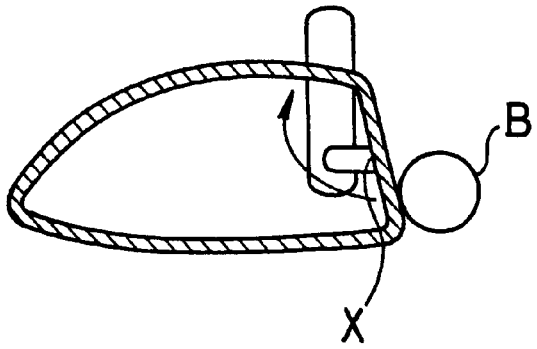
FIG. 7 is an exemplary view showing a displacement when the ball is stricken at a lower side of the face surface of the golf club head according to the present invention.
Figure 8:
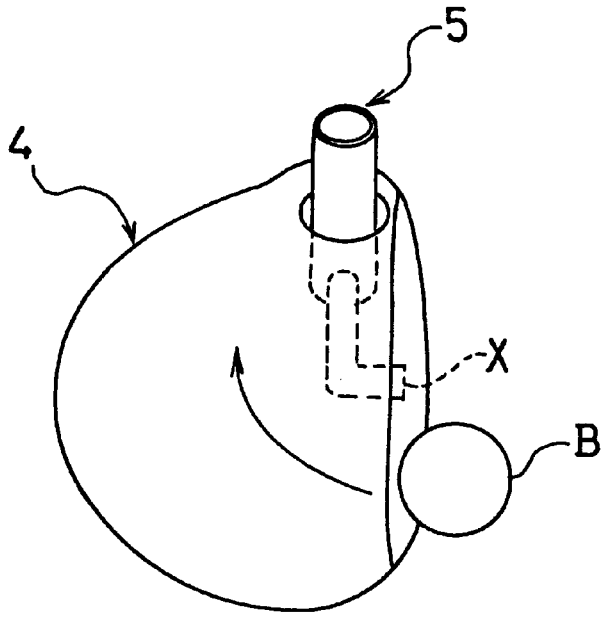
FIG. 8 is an exemplary view showing a displacement when the ball is stricken at a toe portion of the face surface of the golf club head according to the present invention.
Figure 9:
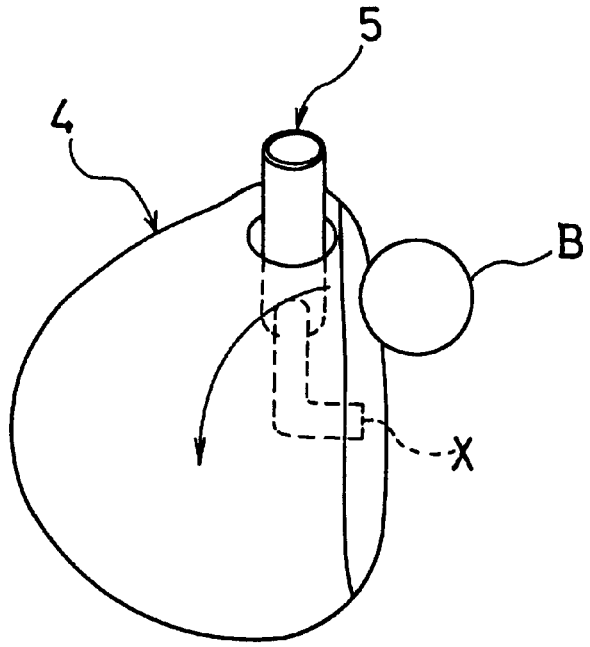
FIG. 9 is an exemplary view showing a displacement when the ball is stricken at a heel side of the face surface of the golf club head according to the present invention.

The above-described displacement will be described in detail with reference to FIGS. 6 to 9. As shown in FIG. 6, when the ball striking position of a ball B is above the joined portion X, the displacement occurs so that the face surface turns upward, thus backspin reduces. As shown in FIG. 7, when the ball striking position of the ball B is below the joined portion X, the displacement occurs so that the face surface turns downward, thus backspin increases. As shown in FIG. 8, when the ball striking position of the ball B is at the toe side from the joined portion X, the displacement occurs so that the face surface turns to the right (opposite to a golfer), thus hookspin increases. As shown in FIG. 9, when the ball striking position of the ball B is at the heel side from the joined portion X, the displacement occurs so that the face surface turns to the left (to the golfer), thus slicespin increases.

Since the present invention gives the above-described spin characteristic to the golf club head, it brings about the following effects according to a setting position of the joined portion X between the hosel portion 5 and the face portion 1.

In the case where the joined portion X between the hosel portion 5 and the face portion 1 is arranged at the position coincides with the sweet spot of the face surface, when the ball is stricken at the position off from the sweet spot, in addition to the gear effect around the center of gravity, the gear effect by the relative displacement of the head main body 4 and the hosel portion 5 is obtained. Therefore, when the ball striking position is at the upper side of the face surface, the carry increases because backspin reduces with an increase of a launching angle of the ball. When the ball striking position is at the lower side of the face surface, the carry increases because backspin increases as well as a reduction of a launching angle of the ball. When the ball striking position is at the toe portion of the face surface, although a launching direction of the ball is in the right, the ball landing point is directed toward the central area of the golf course because hookspin increases. When the ball striking position is at the heel portion of the face surface, although a launching direction of the ball is in the left, the ball landing point is directed toward the central area of the golf course because slicespin increases.

On the other hand, when the joined portion X between the hosel portion 5 and the face portion 1 is arranged at the position off from the sweet spot of the face surface, the spin characteristic of the ball can be optionally set at the golfer's request. When the joined portion X is arranged at the upper side of the face surface, a golf club head which tends to increase backspin can be constituted. Such a golf club head is suitable for a golfer who wants to launch the ball high. When the joined portion X is arranged at the lower side of the face surface, a golf club head which tends to reduce backspin can be constituted. Such a golf club head is suitable for a golfer who wants to increase the carry. When the joined portion X is arranged at the toe side of the face surface, a golf club head which tends to increase slicespin can be constituted. Such a golf club head is suitable for a golfer who wants to prevent a hook. When the joined portion X is arranged at the heel side of the face surface, a golf club head which tends to increase hookspin can be constituted. Such a golf club head is suitable for a golfer who wants to prevent a slice.

Moreover, in the above-described golf club head, since the head main body 4 and the hosel portion 5 relatively displace, the load to the shaft is reduced, thus a break of the shaft can be prevented.

EXAMPLE

In the golf club head having the hollow structure, there were made the golf club head according to the first embodiment, in which the through hole for inserting the shaft into the crown portion was provided and the hosel portion was joined to the back surface of the face portion while the hosel portion is made to be in a non-contact state with the crown portion, and a golf club head of a prior art, in which the hosel portion is joined to the crown portion. In the golf club head of the first embodiment, the joined portion between the hosel portion and the face portion is arranged in a position coinciding with the sweet spot of the face surface. Note that a head mass was set at 200 g and the loft angle was set at 10 degrees.

These golf club heads of the first embodiment and the prior art were attached to club shafts, and the ball was stricken at a head speed of 40 m/s with the ball striking position varied by using a swinging robot. Measurement was performed for: a ball initial velocity (m/s); a ball launching angle (degree); an amount of backspin (rpm) immediately after the ball was stricken; an amount of sidespin (rpm) immediately after the ball was stricken; a carry (m); and an amount of drift of the ball landing point from the center of the golf course (m). The result is shown in Table 1.

Figure 10:
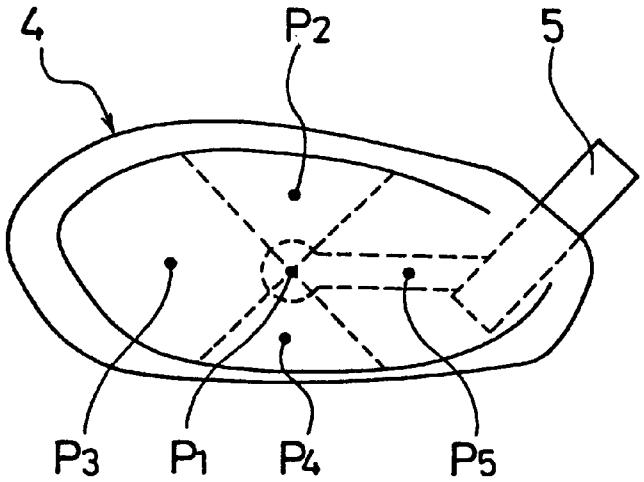
FIG. 10 is an exemplary view showing a ball striking position on the face surface of a first embodiment.
Figure 15:
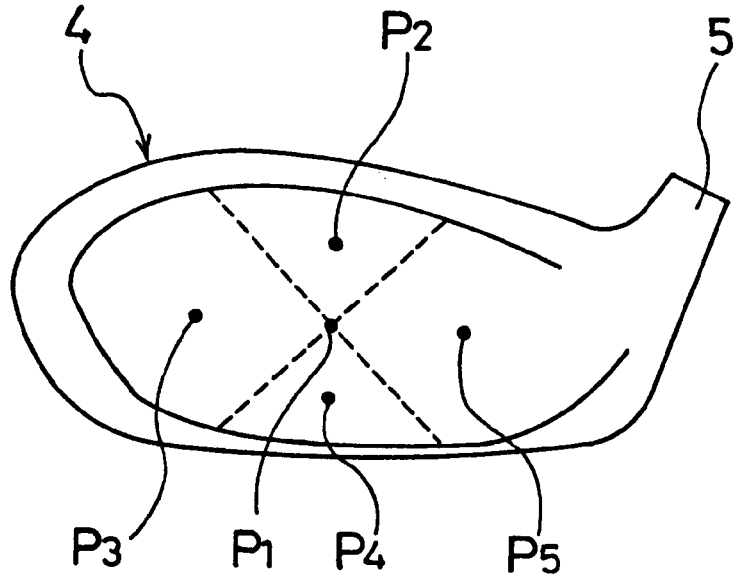
FIG. 15 is an exemplary view showing the ball striking position on the face surface of a prior art.

The measurement result of Table 1 shows mean values of five times of test shots. The ball striking positions ($P_1$ to $P_5$) of the first embodiment and the prior art are shown in FIGS. 10 and 15, where the ball striking position $P_1$ is the sweet spot. With regard to the amount of sidespin, hookspin and slicespin were shown in + and − values respectively. In addition, regarding the amount of drift of the ball landing point from the center (m), the amount of drift to the left side and the right side were shown in + and − values respectively, meaning that the smaller the amount of drift of the ball landing point is, the better the ball direction control is.

TABLE 1

| | Ball striking position | Ball initial velocity (m/s) | Ball launching angle (degree) | Backspin (rpm) | Sidespin (rpm) | Carry (m) | Amount of drift of ball landing point (m) |
|---|---|---|---|---|---|---|---|
| Prior art | $P_1$ | 59.8 | 10.2 | 3400 | 100 | 208 | +1 |
| | $P_2$ | 56.7 | 12.1 | 2800 | 200 | 201 | +2 |
| | $P_3$ | 55.1 | 10.9 | 3200 | 600 | 187 | −8 |
| | $P_4$ | 57.2 | 8.3 | 3900 | −200 | 197 | −2 |
| | $P_5$ | 55.7 | 9.6 | 3300 | −500 | 191 | +8 |
| First embodiment (joined portion at sweet spot) | $P_1$ | 59.6 | 10.4 | 3300 | 100 | 206 | +1 |
| | $P_2$ | 55.9 | 12.9 | 2200 | 200 | 205 | +2 |
| | $P_3$ | 54.6 | 11.1 | 3000 | 900 | 184 | −3 |
| | $P_4$ | 56.6 | 7.9 | 4300 | −100 | 199 | −1 |
| | $P_5$ | 55.1 | 9.2 | 3100 | −900 | 189 | +2 |

As it is understood from Table 1, the golf club head of the first embodiment increased carries at the ball striking positions $P_2$ $P_4$, which are off from the sweet spot in the upper or lower directions, in comparison with the golf club head of the prior art. Moreover, the amounts of drift of the ball landing point were small at the ball striking positions $P_3$, $P_5$, which are off from the sweet spot in the toe or heel direction, and a ball direction control was superior.

Figure 11:
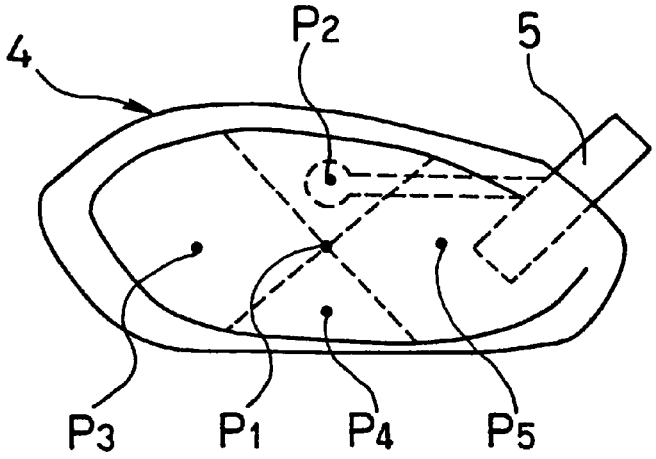
FIG. 11 is an exemplary view showing the ball striking position on the face surface of a second embodiment.
Figure 12:
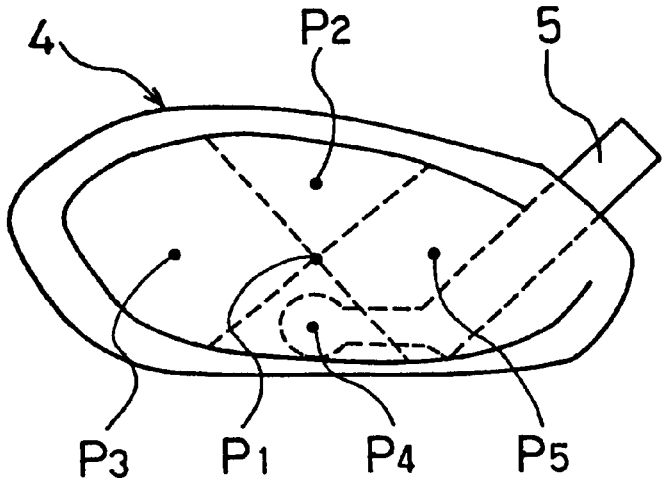
FIG. 12 is an exemplary view showing the ball striking position on the face surface of a third embodiment.
Figure 13:
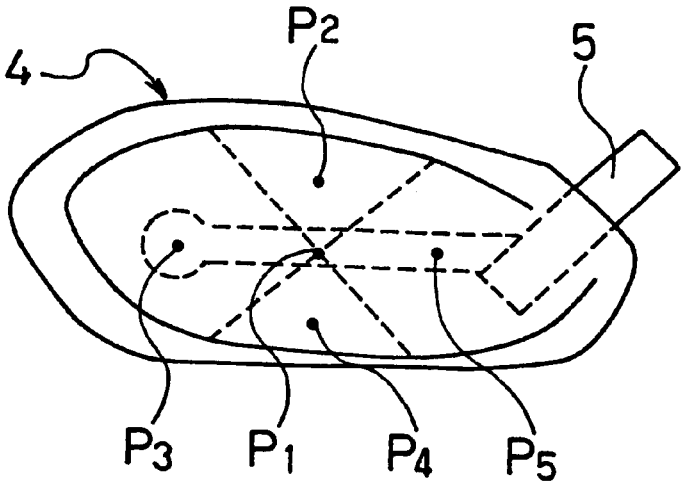
FIG. 13 is an exemplary view showing the ball striking position on the face surface of a fourth embodiment.
Figure 14:
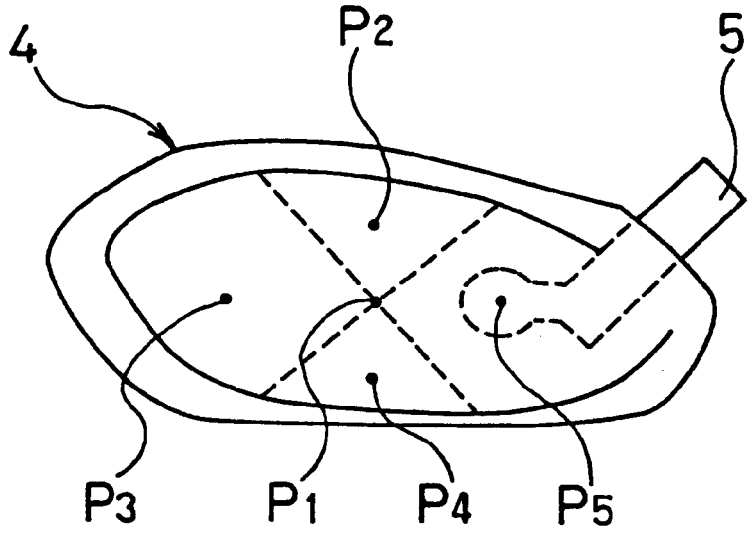
FIG. 14 is an exemplary view showing the ball striking position on the face surface of a fifth embodiment.

Next, golf club heads of the second to fifth embodiments were made similarly to the ones of the first embodiment except for setting the joined portion between the hosel portion and the face portion at the position off from the sweet spot. The golf club head of the second embodiment, as shown in FIG. 11, has the joined portion between the hosel portion and the face portion arranged at the upper side of the face surface. The golf club head of the third embodiment, as shown in FIG. 12, has the joined portion between the hosel portion and the face portion arranged at the lower side of the face surface. The golf club head of the fourth embodiment, as shown in FIG. 13, has the joined portion between the hosel portion and the face portion arranged at the toe side of the face surface. The golf club head of the fifth embodiment, as shown in FIG. 14, has the joined portion between the hosel portion and the face portion arranged at the heel side of the face surface.

Test shots similarly to the above-described test were performed for the golf club heads of these second to fifth embodiments, and the results are respectively shown Tables 2 to 5.

TABLE 2

| | Ball striking position | Ball initial velocity (m/s) | Ball launching angle (degree) | Backspin (rpm) | Sidespin (rpm) | Carry (m) | Amount of drift of ball landing point (m) |
|---|---|---|---|---|---|---|---|
| Prior art | $P_1$ | 59.8 | 10.2 | 3400 | 100 | 208 | +1 |
| | $P_2$ | 56.7 | 12.1 | 2800 | 200 | 201 | +2 |
| | $P_3$ | 55.1 | 10.9 | 3200 | 600 | 187 | −8 |
| | $P_4$ | 57.2 | 8.3 | 3900 | −200 | 197 | −2 |
| | $P_5$ | 55.7 | 9.6 | 3300 | −500 | 191 | +8 |
| Second embodiment (joined portion at upper side) | $P_1$ | 59.3 | 9.8 | 3700 | 0 | 205 | +1 |
| | $P_2$ | 56.3 | 12.2 | 2900 | 100 | 202 | +2 |
| | $P_3$ | 54.4 | 10.9 | 3500 | 700 | 184 | −5 |
| | $P_4$ | 56.2 | 7.2 | 4700 | −100 | 197 | −1 |
| | $P_5$ | 55.0 | 8.8 | 3500 | −600 | 188 | −7 |

TABLE 3

| | Ball striking position | Ball initial velocity (m/s) | Ball launching angle (degree) | Backspin (rpm) | Sidespin (rpm) | Carry (m) | Amount of drift of ball landing point (m) |
|---|---|---|---|---|---|---|---|
| Prior art | $P_1$ | 59.8 | 10.2 | 3400 | 100 | 208 | +1 |
| | $P_2$ | 56.7 | 12.1 | 2800 | 200 | 201 | +2 |
| | $P_3$ | 55.1 | 10.9 | 3200 | 600 | 187 | −8 |
| | $P_4$ | 57.2 | 8.3 | 3900 | −200 | 197 | −2 |
| | $P_5$ | 55.7 | 9.6 | 3300 | −500 | 191 | +8 |
| Third embodiment (joined portion at lower side) | $P_1$ | 59.2 | 10.6 | 3000 | −100 | 210 | −1 |
| | $P_2$ | 55.6 | 13.2 | 1800 | −100 | 207 | −1 |
| | $P_3$ | 54.4 | 11.8 | 2800 | 800 | 188 | −3 |
| | $P_4$ | 56.8 | 8.3 | 3800 | −100 | 200 | −1 |
| | $P_5$ | 55.0 | 9.9 | 2900 | −600 | 192 | +3 |

TABLE 4

| | Ball striking position | Ball initial velocity (m/s) | Ball launching angle (degree) | Backspin (rpm) | Sidespin (rpm) | Carry (m) | Amount of drift of ball landing point (m) |
|---|---|---|---|---|---|---|---|
| Prior art | $P_1$ | 59.8 | 10.2 | 3400 | 100 | 208 | +1 |
| | $P_2$ | 56.7 | 12.1 | 2800 | 200 | 201 | +2 |
| | $P_3$ | 55.1 | 10.9 | 3200 | 600 | 187 | −8 |
| | $P_4$ | 57.2 | 8.3 | 3900 | −200 | 197 | −2 |
| | $P_5$ | 55.7 | 9.6 | 3300 | −500 | 191 | +8 |
| Fourth embodiment (joined portion at toe side) | $P_1$ | 59.1 | 10.1 | 3300 | −300 | 204 | −3 |
| | $P_2$ | 55.4 | 12.8 | 2100 | −300 | 202 | −3 |
| | $P_3$ | 54.8 | 10.9 | 3100 | 500 | 185 | −9 |
| | $P_4$ | 56.3 | 7.7 | 4200 | −400 | 197 | −4 |
| | $P_5$ | 54.6 | 9.0 | 3000 | −1000 | 187 | +1 |

TABLE 5

| | Ball striking position | Ball initial velocity (m/s) | Ball launching angle (degree) | Backspin (rpm) | Sidespin (rpm) | Carry (m) | Amount of drift of ball landing point (m) |
|---|---|---|---|---|---|---|---|
| Prior art | $P_1$ | 59.8 | 10.2 | 3400 | 100 | 208 | +1 |
| | $P_2$ | 56.7 | 12.1 | 2800 | 200 | 201 | +2 |
| | $P_3$ | 55.1 | 10.9 | 3200 | 600 | 187 | −8 |
| | $P_4$ | 57.2 | 8.3 | 3900 | −200 | 197 | −2 |
| | $P_5$ | 55.7 | 9.6 | 3300 | −500 | 191 | +8 |
| Fifth embodiment (joined portion at heel side) | $P_1$ | 59.3 | 10.4 | 3400 | 700 | 206 | +8 |
| | $P_2$ | 55.5 | 13.0 | 2600 | 600 | 201 | +6 |
| | $P_3$ | 54.3 | 11.6 | 3300 | 1100 | 185 | +4 |
| | $P_4$ | 56.4 | 8.0 | 4300 | 200 | 198 | +3 |
| | $P_5$ | 55.6 | 9.5 | 3200 | −200 | 190 | +10 |

As it is understood from these Tables 2 to 5, the golf club heads of the second to fifth embodiments have a variety of spin characteristics according to the positions of the joined portion between the hosel portion and the face portion.

As described above, according to the present invention, since the golf club head is the one in which a head main body of the hollow structure is formed of; the face portion having the face surface; the crown portion adjacent to the face portion; and the sole portion adjacent to the face portion, the through hole for inserting the shaft into the crown portion is provided, the hosel portion for supporting the tip portion of the shaft is joined to the back surface of the face portion, and the hosel portion is made to be in the non-contact state with the crown portion, the relative displacement between the head main body and the hosel portion is permitted. Consequently, the increase of the carry and the improvement of the ball direction control can be achieved. Moreover, the break of the shaft can be prevented.

What is claimed is:

1. A golf club head comprising:

a hollow main body having a heel side and a toe side and including a face portion having a front surface and a back surface, a crown portion adjacent to the face portion, and a sole portion adjacent to the face portion; and a hosel having a cylindrical shaft support portion extending from within the hollow main body near the heel side through a hole in the crown portion with clearance to be out of contact with the crown portion, and a generally L-shaped hosel connection portion having two arms, each having a free end, one of the two arms having the free end thereof joined to the cylindrical shaft support portion and extending in generally parallel spaced relation to the face and sole portions, the other of the two arms lying generally perpendicular to the face portion and having its free end joined to the back surface of the face portion.

2. The golf club head according to claim 1, wherein the clearance between the hole in said crown portion and said cylindrical portion of the hosel is blocked with an elastic member.

3. The golf club head according to claim 2, wherein said elastic member is constituted of one of rubber and resin.

4. The golf club head according to anyone of claims 1, 2, or 3, wherein the free end of the other of the two arms joined to said face portion coincides with a sweet spot of said face surface.

5. The golf club head according to anyone of claims 1, 2, or 3, wherein the free end of the other of the two arms joined to said face portion is offset from a sweet spot of said face surface.

* * * * *